US005171180A

United States Patent [19]

Lee

[11] Patent Number: 5,171,180

[45] Date of Patent: Dec. 15, 1992

[54] METHOD FOR MANUFACTURING IMPREGNATED CATHODES

[75] Inventor: Kyung S. Lee, Kyungsangbook-Do, Rep. of Korea

[73] Assignee: Gold Star Co., Ltd., Rep. of Korea

[21] Appl. No.: 871,340

[22] Filed: Apr. 21, 1992

[30] Foreign Application Priority Data

Apr. 23, 1991 [KR] Rep. of Korea ..... 6504/1991

[51] Int. Cl.[5] ..... H01J 9/04; H01J 19/06

[52] U.S. Cl. ..... 445/51; 313/346 DC

[58] Field of Search ..... 445/50, 51; 313/346 DC

[56] References Cited

U.S. PATENT DOCUMENTS

| | | | |
|---|---|---|---|
| 2,813,220 | 11/1957 | Coppola | 313/345 DC |
| 2,869,017 | 1/1959 | Levi | 445/51 |
| 2,912,611 | 11/1959 | Beck et al. | 445/50 |
| 3,238,596 | 3/1966 | Rich et al. | 445/51 |

*Primary Examiner*—Richard K. Seidel
*Assistant Examiner*—Jeffrey T. Knapp
*Attorney, Agent, or Firm*—Ostrolenk, Faber, Gerb & Soffen

[57] ABSTRACT

A method for manufacturing an impregnated cathode wherein an impregnated pallet is fixedly fitted in a cathode cup. The method comprises the step of disposing electron emitting materials together with a porous pallet in the cathode cup and impregnating the electron emitting materials in the porous pallet to produce the impregnated pallet. The cathode cup is constituted by alloying an oxidative metal or alloy, such as silicon (Si), nickel (Ni) or chromium (Cr), which tends to react oxidatively with the electron emitting materials, in a high heat-resistant metal. In the impregnation process, a bonding of the impregnated pallet to the cathode cup can be achieved by an oxidation reaction between the electron emitting matetrials in the impregnated pallet and the oxidative material in the cathode cup, without any expensive brazing metals or alloys. As a result, it is possible to reduce the manufacturing cost and the total manufacturing processes.

8 Claims, 2 Drawing Sheets

METHOD FOR MANUFACTURING IMPREGNATED CATHODES

BACKGROUND OF THE INVENTION

1. Field of the Invention

The present invention relates to a method for manufacturing an impregnated cathode wherein an impregnated pallet is fixedly fitted in a cathode cup, and more particularly to a method for manufacturing an impregnated cathode wherein upon a process of impregnating an electron emitting material in a porous pallet to produce an impregnated pallet, fixing of the impregnated pallet to a cathode cup is achieved by an oxidation reaction between the electron emitting material and an oxidative material of the cathode cup.

2. Description of the Prior Art

Generally, impregnated cathodes have been used in oscilloscopes which require high current density. Recently, they have been also applied to electron tubes which are used in televisions, since the electron tubes require high resolution and large screen in televisions.

Referring to FIG. 1, there is shown an example of general impregnated cathode constructions. As shown in the drawing, the cathode comprises a cylindrical cathode cup 2 closed at its lower end and made of a high-resistant material, such as molybdenum (Mo). An impregnated pallet 1 is fixedly fitted in the cathode cup 2. The impregnated pallet 1 is made by impregnating an electron emitting material in a porous pallet of a heat-resistant metal such as tungsten (W). The cathode also comprises a cylindrical cathode sleeve 3 made of a high heat-resistant material such as molybdenum (Mo). The cathode sleeve 3 receives the cathode cup 2 in its upper end. Within the cathode sleeve 3, a heater 4 adapted to heat the cathode is disposed at the lower portion of cathode sleeve 3.

The impregnated cathode with the above-mentioned construction is disposed in position within an electron gun of electron tube. In operation, as a drive power is applied to the heater 4 disposed in the cathode sleeve 3, the heater 4 generates heat. According to the heating of heater 4, heat is accumulated in the cathode sleeve 3 and then transferred to the cathode cup 2. The transferred heat to the cathode cup 2 is then transmitted to the impregnated pallet 1, so that the impregnated pallet 1 emits electrons, by virtue of the transmitted heat.

In manufacturing such a general impregnated cathode, the electron emitting material is conventionally prepared by mixing BaO and CaO obtained by decomposing $BaCO_3$ and $CaCO_3$ at high temperature, with $Al_2O_3$. Such type of electron emitting material is melted and impregnated in pores of a porous pallet under a predetermined impregnation atmosphere, so as to form the impregnated pallet 1. As the impregnation atmosphere, a vacuum or inert gas atmosphere maintained at a temperature of about 1,600° C. is used.

After completing the preparation of impregnated pallet 1, a process for fixedly fitting the cathode cup 2 in the impregnated pallet 1 is performed. As the process, there has been used a method comprising the steps of providing a metal material 5, which is an alloy of molybdenum (Mo) and ruthenium (Ru) or a brazing metal, between the inner closed bottom surface of cathode cup 2 and the impregnated pallet 1 fitting into the cathode cup 2, and then carrying out a brazing at a high temperature.

After completing the fitting, the cathode cup 2 is fixedly fitted in the upper end of cathode sleeve 3 such that its outer peripheral surface is in tight contact with the inner peripheral surface of the upper end of cathode sleeve 3. Thereafter, the heater 4 is inserted into the lower portion of cathode sleeve 3. Thus, the above-mentioned cathode construction is obtained.

However, this conventional method, wherein a brazing at high temperature is carried out to bond the impregnated pallet 1 to the cathode cup 2 under the condition that the metal material 5 is filled between the impregnated pallet 1 and cathode cup 2, has a disadvantage of an increase in manufacturing cost, since the material 5 which is a brazing metal or alloy is expensive.

SUMMARY OF THE INVENTION

Therefore, an object of the invention is to provide a methode for manufacturing an impregnated cathode which is capable of reducing the manufacturing cost.

Another object of the invention is to provide a method for manufacturing an impregnated cathode which is capable of reducing the total manufacturing processes, as compared with the prior art.

In one aspect, the present invention provides a method for manufacturing an impregnated cathode, comprising the steps of: disposing a first electron emitting material with a predetermined thickness and then a porous pallet on the inner bottom surface of a cathode cup containing an oxidative material; applying a predetermined pressure downwardly to the upper portion of the porous pallet, to impregnate the first electron emitting material in the porous pallet and at the same time to fix the porous pallet to the cathode cup; disposing a second electron emitting material with a predetermined thickness on the upper portion of porous pallet; and impregnating the second electron emitting material in the porous pallet in a predetermined impregnation atmosphere and at the same time fixing the porous pallet to the cathode cup.

In another aspect, the present invention also provides a method for manufacturing an impregnated cathode, comprising the steps of: disposing a first electron emitting material with a predetermined thickness, a porous pallet and a second electron emitting material with a predetermined thickness, in turn, on the inner bottom surface of a cathode cup; and applying a predetermined pressure downwardly to the second electron emitting material, to impregnate both the first electron emitting material and the second electron emitting material in the porous pallet and at the same time fixedly bond the porous pallet to the cathode cup.

In accordance with the present invention, the cathode cup is made of a high heat-resistant metal alloy which is obtained by alloying an oxidative metal or alloy, such as silicon (Si), nickel (Ni) or chromium (Cr), which tends to react oxidatively with the electron emitting materials, in a high heat-resistant metal such as molybdenum (Mo) or tantalum (Ta).

BRIEF DESCRIPTION OF THE DRAWINGS

Other objects and aspects of the invention will become apparent from the following description of embodiments with reference to the accompanying drawings in which:

FIGS. 2A to 2D are schematic views for explaining a method for manufacturing an impregnated cathode, wherein FIG. 2A shows a first impregnation step, FIG. 2B the result obtained by the first impregnation, FIG. 2C a second impregnation step, and FIG. 2D the result obtained by the second impregnation.

DESCRIPTION OF THE PREFERRED EMBODIMENTS

Referring to FIGS. 2A to 2D, there is shown a method for manufacturing an impregnated cathode in accordance with an embodiment of the present invention.

Figure 1:
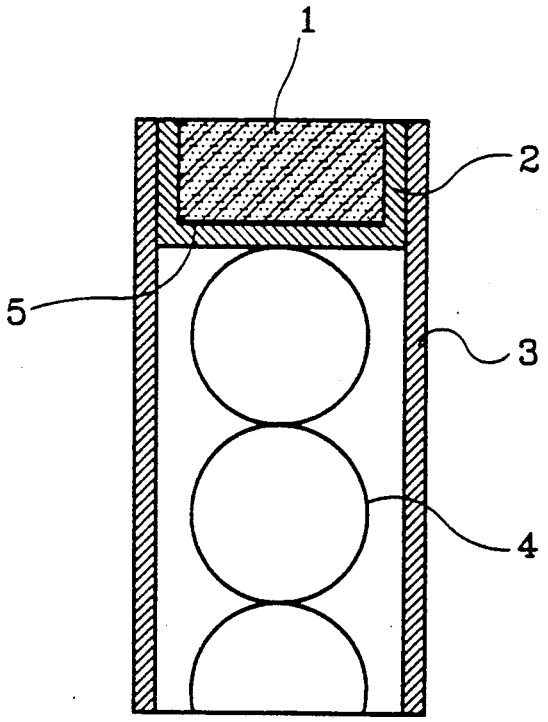
FIG. 1 PRIOR ART
FIG. 1 is a sectional view of a general impregnated cathode construction.
Figure 2A:
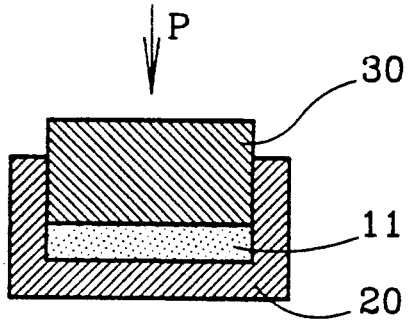
Figure 2B:
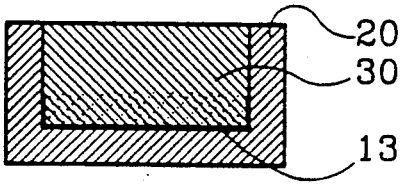

In accordance with the method of the present invention, a first electron emitting material 11 is first disposed on the inner bottom surface of a cathode cup 20 containing an oxidative material, as shown in FIG. 2A. On the first electron emitting material 11, a porous pallet 30 is disposed.

Thereafter, an impregnation process is performed by applying a predetermined pressure P downwardly to the upper portion of the porous pallet 30 in a vacuum or inert gas atmosphere maintained at a temperature of about 1,600° C.

By the impregnation process, the first electron emitting material is melted and impregnated in the porous pallet 30. At the same time, the first electron emitting material reacts oxidatively with the oxidative material contained in the cathode cup 20, producing a bonding layer 13 therebetween, so that the porous pallet 30 is fixedly bonded to the cathode cup 20, by virtue of the bonding layer 13.

Figure 2C:
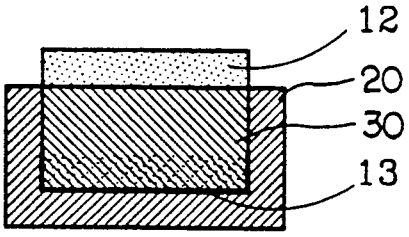

At this state wherein the porous pallet 30 is fixedly bonded to the cathode cup 20, the electron emitting material has been impregnated only in the lower portion of porous pallet 30. In order to also impregnate the upper portion of porous pallet 30, a second electron emitting material 12 is disposed on the porous pallet 30 and an impregnation process is performed in a vacuum or inert gas atmosphere maintained at a high temperature of about 1,600° C., as shown in FIG. 2C.

Figure 2D:
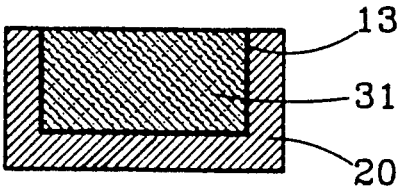

As a result, an impregnated pallet 31 is obtained from the porous pallet 30 which is totally impregnated with electron emitting materials 11 and 12, as shown in FIG. 2D. The bonding layer 13 is produced by an oxidation reaction of the electron emitting materials 11 and 12 in the impregnated pallet 31 and the oxidable material in cathode cup 20 and serves to bond the impregnated pallet 31 and the cathode cup 20.

The first electron emitting material 11 is of a composite oxide such as BaO, CaO, or $Al_2O_3$. As the electron emitting material 11, a sintered product is used which is cut to have a proper thickness. On the other hand, the cathode cup 20 is constituted by alloying an oxidative metal or alloy, such as silicon (Si), nickel (Ni) or chromium (Cr), which tends to react oxidatively with the electron emitting materials, in a high-resistant metal such as molybdenum (Mo) or tantalum (Ta). The electron emitting materials are likely to react oxidatively with the oxidative meterial of the cathode cup 20, thereby producing the bonding layer 13.

For example, in case where silicon (Si) is used as the oxidative material of cathode cup 20, the following typical oxidation, reaction is expected between the electron materials of impregnated pallet 31 and the oxidative material of cathode cup 20:

$$4BaO + Si \xrightarrow[\Delta]{} Ba_2SiO_4 + 2Ba$$

$Ba_2SiO_4$ produced by the above reaction forms the bonding layer 13 and functions to bond strongly the impregnated pallet 1 and the cathode cup 20.

After completing the fixing of impregnated pallet 31 to the cathode cup 20, a cathode sleeve 3 is fitted around the cathode cup 20. Within the cathode sleeve 3, a heater 4 is disposed. Thus, a cathode construction in accordance with the embodiment of the present invention is obtained.

In accordance with another embodiment of the present invention, there is also provided a method for manufacturing an impregnated cathode which is modified from the above-mentioned method. This method comprises the steps of disposing the first electron emitting material 11, the porous pallet 30 and the second electron emitting material 12, in turn, on the inner bottom surface of cathode cup 20, applying a predetermined pressure downwardly to the second electron emitting material 12, to impregnate both the first electron emitting material 11 and the second electron emitting material 12 in the porous pallet 30 and at the same time to fixedly bond the porous pallet to the cathode cup.

In similar to the first embodiment, the cathode cup 20 is made of a high heat-resistant metal alloy which is obtained by alloying an oxidative metal or alloy, such as silicon (Si), nickel (Ni) or chromium (Cr), which tends to react oxidatively with the electron emitting materials, in a high heat-resistant metal such as molybdenum (Mo) or tantalum (Ta). As the impregnation atmosphere, a vacuum or inert gas atmosphere maintained at a temperature of about 1,600° C. is used.

Since the impregnation of electron emitting materials 11 and 12 in the porous pallet 30 is achieved by a single impregnation step of impregnating both the first electron emitting material 11, and the second electron emitting material 12 in the porous pallet 30, to form the impregnated pallet 31 and provide the bonding between the impregnated pallet 31 and the cathode cup 20 in accordance with the second embodiment, one impregnation step can be eliminated, as compared with the first embodiment.

As apparent from the above description, the present invention provides a method for manufacturing an impregnated cathode wherein the bonding of the impregnated pallet to the cathode cup can be achieved by an oxidation reaction between the electron emitting materials in the impregnated pallet and the oxidative material in the cathode cup, without any expensive brazing metals or alloys. As a result, it is possible to reduce the manufacturing cost. The bonding between the impregnated pallet and the cathode cup is accomplished in the impregnation process, thereby reducing the total manufacturing processes.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacturing an impregnated cathode, comprising the steps of:

disposing a first electron emitting material with a predetermined thickness and then a porous pallet on an inner bottom surface of a cathode cup containing an oxidative material;

applying a predetermined pressure downwardly to the upper portion of the porous pallet under a predetermined impregnation atmosphere, to impregnate the first electron emitting material in the porous pallet and at the same time to fix the porous pallet to the cathode cup;

disposing a second electron emitting material with a predetermined thickness on the upper portion of porous pallet; and impregnating the second electron emitting material in the porous pallet under a predetermined impregnation atmosphere and at same time fixing the porous pallet to the cathode cup.

2. The method of claim 1, wherein the cathode cup is constituted by alloying an oxidative metal or alloy, which tends to react oxidatively with the electron emitting materials in the impregnation step, high heat-resistant metal.

3. The method of claim 1, wherein the impregnation atmosphere is a vacuum or inert gas atmosphere maintained at a temperature of about 1,600° C.

4. A method for manufacturing an impregnated cathode, comprising the steps of:

disposing a first electron emitting material with a predetermined thickness, a porous pallet and a second electron emitting material with a predetermined thickness, in turn, on an inner bottom surface of a cathode cup; and applying a predetermined pressure downwardly to the second electron emitting material under a predetermined impregnation atmosphere, to impregnate both the first electron emitting material and the second electron emitting material in the porous pallet and at the same time to fixedly bond the porous pallet to the cathode cup.

5. The method of claim 4, wherein the cathode cup is constituted by alloying an oxidative metal or alloy, which tends to react oxidatively with the electron emitting materials in the impregnation step, in a high heat-resistant metal.

6. The method of claim 4, wherein the impregnation atmosphere is a vacuum or inert gas atmosphere maintained at a temperature of about 1,600° C.

7. The method of claim 2, wherein the oxidative metal or alloy is silicon, nickel or chromium.

8. The method of claim 5, wherein the oxidative metal or alloy is silicon, nickel or chromium.

* * * * *